United States Patent [19]

King

[11] Patent Number: 4,631,776

[45] Date of Patent: Dec. 30, 1986

[54] FOOT OPERATED DOOR CHECK

[76] Inventor: Mavis King, 8400 Shore Front Parkway, Rockaway Beach, N.Y. 11693

[21] Appl. No.: 739,841

[22] Filed: May 31, 1985

[51] Int. Cl.[4] ..... E05F 5/02

[52] U.S. Cl. ..... 16/82; 16/DIG. 10; 292/DIG. 15

[58] Field of Search ..... 16/82, 85, DIG. 10; 292/207, 219, 228, 338, DIG. 15

[56] References Cited

U.S. PATENT DOCUMENTS 1,469,693 10/1923 St. Cloud ..... 16/85 X 3,805,322 4/1974 Serrano ..... 16/85 X 3,833,963 9/1974 Waters ..... 16/82

4,216,986 8/1980 McNinch et al. ..... 16/82 X

*Primary Examiner*—Fred Silverberg

*Attorney, Agent, or Firm*—Howard M. Schwinger

[57] ABSTRACT

A door check consisting of a base plate having a check plate pivotally attached thereto so as to be pivotable upwardly therefrom to abut and check a swinging door, the base plate and the check plate being substantially the same shape and size, the base plate being adapted to be immovably affixed to flooring within proximity of the door, the assemblage permitting of flush mounting within a recess formed in the floor.

1 Claim, 3 Drawing Figures

FOOT OPERATED DOOR CHECK

This invention relates to door checks and more particularly to a door check which can prevent door movement regardless of the amount of force applied on the door.

The door check of the present invention is intended to prevent "push ins", i.e., where a door is opened slightly to view what turns out to be an intruder who then forces the door to fully open so access to the interior can be obtained.

Although such door checks have heretofore been proposed they have been deficient in one respect or another particularly with respect to reliability, appearance and general safety.

It is therefore amongst the primary objects of the present invention to provide a door check which will prevent a door from being forced open regardless of the force applied.

It is another important object of the present invention to provide a door check which is maintained out of sight when in a position of readiness.

It is still a further object of the present invention to provide a door check which will not encumber a door passageway in any manner when maintained in a position of readiness and thus does not create a safety hazard.

Figure 1:
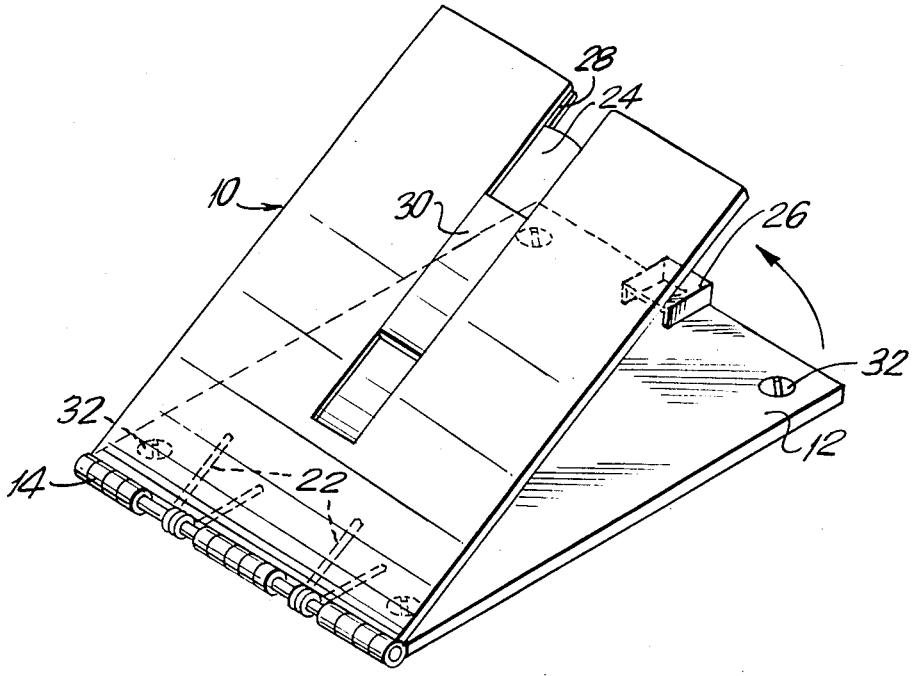
Figure 2:
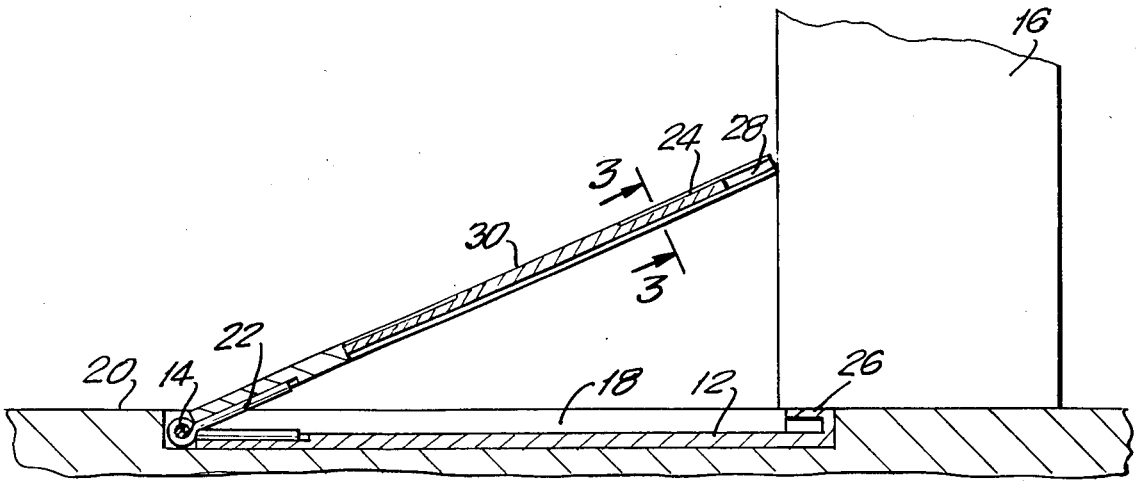
Figure 3:
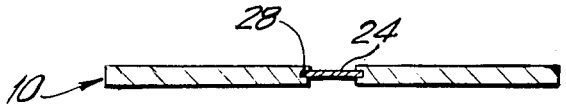

Other objects and advantages of the present invention will become apparent from a reading of the following specification which makes reference to the accompanying drawing wherein:

FIG. 1 is a perspective view of an embodiment of the door check of the present invention, FIG. 2 is a sectional view of the embodiment of FIG. 1 showing the door check abutting a door, and FIG. 3 is another sectional view taken on line 3—3 of FIG. 2 in the direction of the arrows showing the latch.

Referring to the drawing: the embodiment of door check disclosed therein consists of check plate 10 pivotally attached to base plate 12 by hinge 14. Due to its pivotal connection with the base plate, the check plate may be raised to abut and check door 16 as is shown in FIG. 2. In this position of the door check, the door cannot be opened further.

The assemblage is designed to be set in recess 18 formed in floor 20 so as to be normally flush with the floor when the check plate abuts the base plate, i.e., is not in use. By virtue of this flush mounting the floor in the vicinity of the door is hazard free presenting no obstacles or irregularities to an individual traversing the area which could cause him to stumble or fall and thus sustain injury. To accomplish this the base plate and check plate must be of substantially the same size and shape so as to present a minimum of surface irregularties and no break in continuity.

Due to its construction the door check of the present invention is virtually hidden from view when not in use and does not interfere with the aesthetics of the room in which it is placed.

The base plate may be screwed to floor 20 by screws 32 so as to be immovably set in recess 18.

A torsion spring 22 is provided in association with hinge 14 so that the check plate is spring biased and is normally urged upwardly. The check plate is held against the base plate when latch 24 is maintained in catch 26. The check plate is centrally slotted to house latch 24 which is slidably maintained in tracks 28 formed in the check plate. A pedal 30 is provided on the upper surface of latch 24 so the latch can be easily disengaged by foot to achieve the release of the check plate.

It thus may be seen that when the door is to be slightly opened to view a caller, the accupant need merely slide the pedal rearwardly by foot to disengage the latch from the catch and permit the spring biased check plate to rise upwardly to abut the slightly opened door and prevent its further movement.

Although only a single embodiment of the invention has been shown and described herein, it will be realized that variations and modifications may be made which will fall within the spirit and the letter of the following claims.

I claim:

1. A door check comprising a base plate and a check plate each provided with hinge components which form a hinge for hingedly connecting the base plate with the check plate, the check plate being pivotable upwardly to check a swinging door, the plates being substantially of the same shape, a spring mounted directly on the hinge to normally urge the two plates away from each other, said base plate having means for affixation to a base, a foot actuated sliding latch slidably maintained in a slot formed in the check plate, wherein said latch slides in said slot in a direction transverse to the hinge, a catch for said latch disposed on the base plate at an end remote from said hinge, said catch holding the check plate against the base plate when the latch is inserted in the catch, the spring biased check plate moving upwardly of the base plate when the latch is withdrawn from the catch.

* * * * *